United States Patent [19]

Mullins et al.

[11] 4,293,039

[45] Oct. 6, 1981

[54] NON-ROTATING STABILIZER FOR DRILL STRING

[75] Inventors: John M. Mullins; Joseph L. Kelly, Jr., both of Houston, Tex.

[73] Assignee: Hughes Tool Company, Houston, Tex.

[21] Appl. No.: 12,277

[22] Filed: Feb. 15, 1979

[51] Int. Cl.[3] ..... F16C 1/26; F21B 17/10

[52] U.S. Cl. ..... 166/341; 175/325; 308/4 A; 308/134.1

[58] Field of Search ..... 166/341; 175/320, 325; 308/3 C, 4 A, 4 R, 37, 134.1, 139, 76

[56] References Cited

U.S. PATENT DOCUMENTS

| | | | |
|---|---|---|---|
| 2,751,203 | 6/1956 | Compton | 175/325 |
| 3,231,029 | 1/1966 | Winberg | 175/325 |
| 4,083,612 | 4/1978 | Olson | 166/241 |
| 4,098,544 | 7/1976 | Still et al. | 308/4 A |
| 4,133,397 | 6/1979 | Tschirky | 175/325 |
| 4,227,585 | 10/1980 | Glass, Jr. | 175/325 |

*Primary Examiner*—James A. Leppink

*Attorney, Agent, or Firm*—Robert A. Felsman

[57] ABSTRACT

A stabilizer for attachment to drill string in large diameter earth boring or shaft drilling to center the drill string and maintain alignment of the drill bit. The stabilizer has an inner hub that is rigidly secured to the drill string above the bit. A rubber tube inside the inner hub is compressed to lock the inner hub to the drill string. An outer hub encircles the inner hub. A bearing is mounted between the inner hub and outer hub to allow rotation with respect to each other. The bearing includes a frus-to-conical ring in contact with individual pads that are exposed to the drilling fluid. A number of arms extend radially outward from the outer hub to centralize the drill string. The arms are telescopingly received in the outer hub and are pinned together by tie bars at their outer ends to allow them to be quickly removed.

9 Claims, 4 Drawing Figures

NON-ROTATING STABILIZER FOR DRILL STRING

BACKGROUND OF THE INVENTION

1. Field of the Invention

This invention relates in general to earth boring equipment and in particular to a stabilizer for centering a drill string in large diameter shafts.

2. Description of the Prior Art

In drilling of large diameter shafts, approximately 4 to 15 feet in diameter, a single drill bit with a diameter equal to that of the shaft is rotated by a string of drill pipe. The pipe, which is normally only 8 to 20 inches in diameter, is connected to the bit by a large flange, and thrust is applied to the bit by a stack of large do-nut shaped weights which surround the drill string and rest on the upper side of the flange. Because of the limberness of the drill pipe, the clearance between the weight stack and shaft wall, and the cutting action of these large bits, the bits have a tendency to wander from a straight path.

To restrict deviation and keep the bit on course a stabilizer is placed in the weight stack normally near the top. One type of stabilizer known to applicants has a cylindrical frame or hub which surrounds the drill pipe and is sandwiched between two weights. Extending from the central hub are radial arms with vertically oriented rollers mounted at their outer ends for rolling contact with the wall of the shaft.

There are several disadvantages with this type of stabilizer. The rollers have antifriction bearings which require an expensive structure for lubrication and protection from the drilling fluid. Also, the weight of the rollers necessitates a heavy supporting structure and makes them difficult to change. Furthermore, intermittent contact between the rapidly moving rollers and the shaft wall can promote a sloughing of the shaft wall.

Another type of stabilizer has a central structure similar to the roller type with radial arms supporting a continuous cylindrical ring. This arrangement affords simple construction and eliminates the expensive rollers. However, the rubbing of the ring against the wall of the shaft increases energy consumption and promotes wall sloughing and wear of the ring.

Another problem is that the opening in the rig floor is often too small in diameter to allow a stabilizer or bit to be moved through it. The rig floors are elevated a sufficient distance to allow the bit to be fully exposed in the space between the earth surface and the rig floor. However, there is often insufficient room for the bit and the stabilizer both to be exposed below the rig floor. Consequently, the stabilizer must be dismantled in order for the drill bit to be pulled above the earth surface. Dismantling a prior art stabilizer can be cumbersome and time consuming.

SUMMARY OF THE INVENTION

It is accordingly a general object of this invention to provide an improved stabilizer for shaft boring.

It is the further object of this invention to provide an improved stabilizer for shaft boring with arms that do not rotate with the drill shaft.

It is the further object of this invention to provide an improved stabilizer for shaft boring that is easily and quickly dismantled sufficiently to be pulled through the floor opening of the drill rig.

In accordance with these objects, a stabilizer is provided that has an inner hub rigidly secured to the drill string. An outer hub encircles the inner hub. A bearing having a metal frusto-conical ring and individual resilient pads is mounted between the hubs to allow rotation between them. The bearing is exposed to and lubricated by the drilling fluid. A plurality of arms extend radially outward from the outer hub and have shoes on their outer ends for contacting the shaft wall. The arms are received in receptacles in the outer hub and are pinned together by tie bars at their outer ends. Removing the tie bars allows the arms to be pulled out of the receptacles for disassembling the stabilizer.

DESCRIPTION OF PREFERRED EMBODIMENTS

Figure 1:
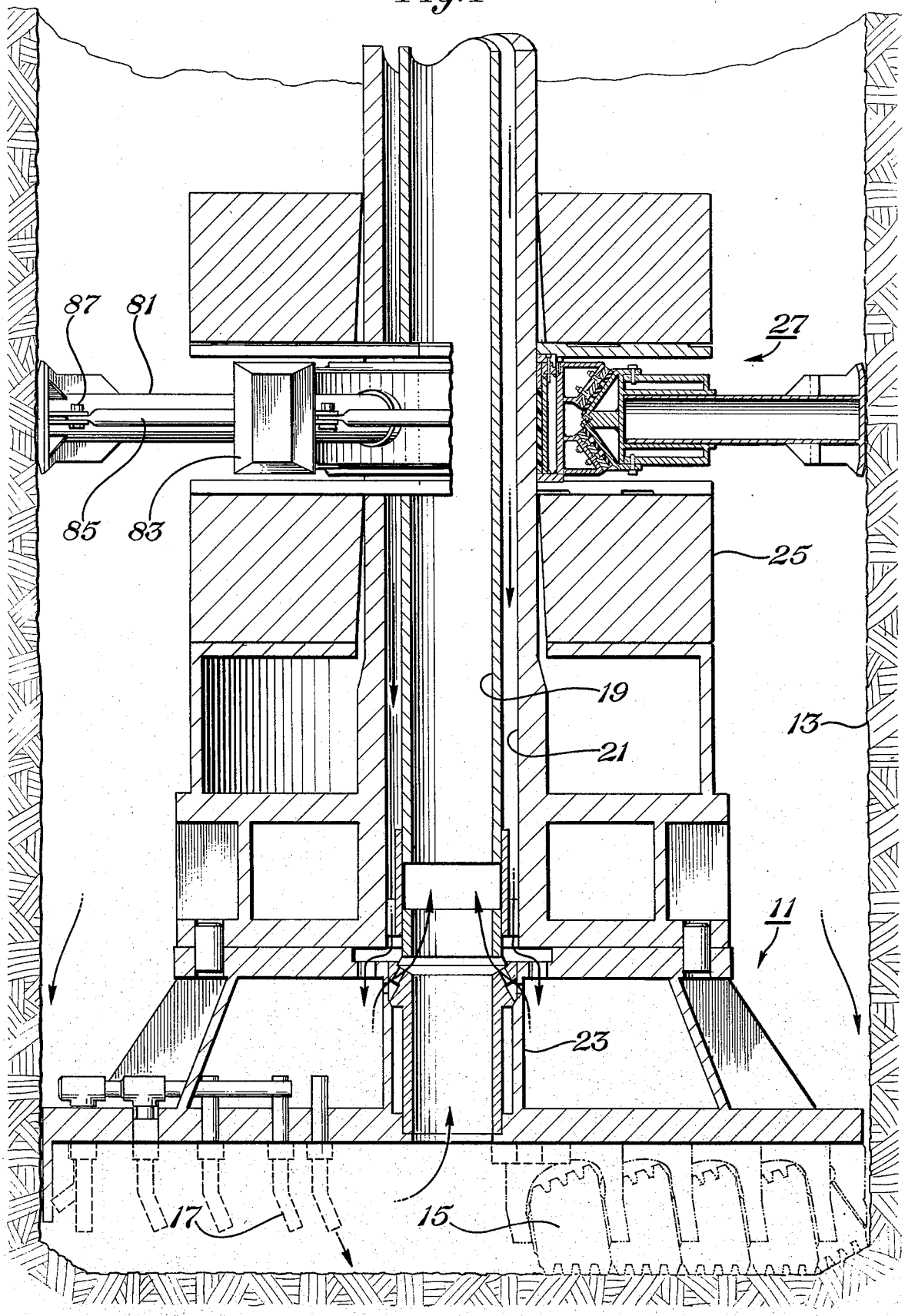
FIG. 1 is a fragmentary vertical sectional view of a stabilizer in accordance with this invention mounted above a drill bit some of which is shown in phantom.

Referring to FIG. 1, a large diameter earth boring drill bit 11 is shown at the bottom of a shaft 13. The drill bit 11 is of a conventional type having a plurality of cutters 15 mounted to its bottom. Each cutter 15 is rotatable and has rows of steel teeth or tungsten carbide inserts for disintegrating the earth formations. Cutters 15 may also be disks as shown in U.S. Pat. No. 3,905,432. A plurality of nozzles 17 are mounted to the drill bit bottom for discharging fluid against the bottom of the shaft. The cutters 15 and nozzles 17 are shown in phantom and are rotated into the plane of the section to show their respective distances from the center of the drill bit.

The drill bit 11 is connected to a string of drill pipe for rotation therewith. The string comprises sections of inner pipe 19 mounted inside sections of outer pipe 21. Fluid, often a mixture of air and water, is pumped down the annular passage between the inner and outer pipes and into a separation chamber 23. As indicated by the arrows in FIG. 1, the air and water separate, with the air returning up the inner passage to lighten the weight of the column, and the water being discharged out the nozzles. The water discharged out of the nozzles combines with downwardly flowing water from the shaft, the combined stream being returned up the inner pipe along with cuttings.

Several cylindrical weights 25 are mounted above the bit to apply force for cutting. The weights 25 are in two halves, connected together on the drill string. Although only two are shown in the drawing, ten or more weights are sometimes stacked in the string.

Figure 2:
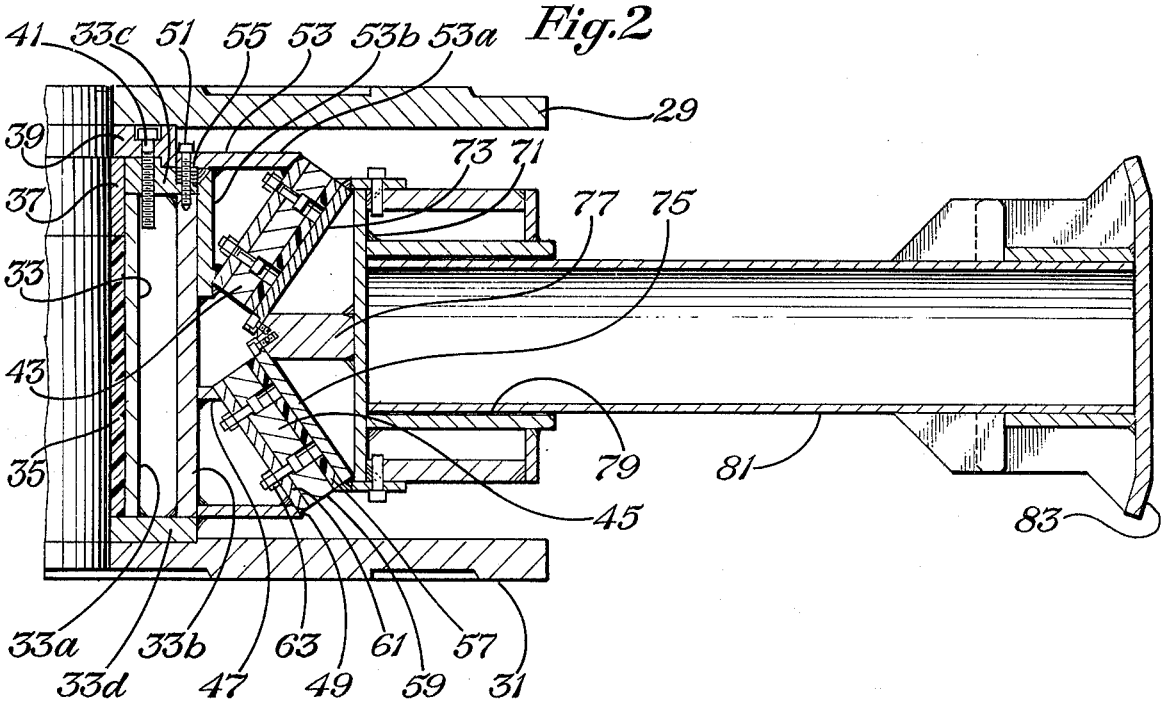
FIG. 2 is an enlarged fragmentary vertical sectional view of the stabilizer of FIG. 1.

A stabilizer 27 is placed in the stack of weights 25. It may be at any desired point above the bit, and is normally about 5 to 50 feet from the bottom of the shaft. Referring also to FIG. 2, the stabilizer has upper and lower adapter plates 29, 31 that contact the weights above and below the stabilizer. An inner hub 33 is carried between the weights 25 and encircles the outer pipe 21. Inner hub 33 is metal and has double cylindrical walls, including an inner cylindrical wall 33*a* and an outer cylindrical wall 33*b*. The inner and outer walls 33*a* and 33*b* are separated and are closed at the top and bottom by annular caps 33*c* and 33*d*. Walls 33*a* and 33*b* and caps 33*c* and 33*d* are welded together.

A resilient tube 35 of rubber or the like is closely received within the inner hub inner wall 33*a*. Resilient tube or sleeve 35 contacts the inner wall of the hub inner wall 33*a* and the outer wall of the outer pipe 21. A metal retaining cylinder 37 is also closely and slidingly received within the inner wall 33*a*. Retaining cylinder 37 is of the same inner and outer diameters as the resilient tube 35 and is carried above it. A retaining ring 39 is mounted to the inner hub upper cap 33*c* by bolts 41 and two dowel pins (not shown). The inner part of retaining ring 39 contacts retaining cylinder 37 and combines with the cylinder to act as retaining means for deforming the resilient tube 35 in the space between outer pipe 21 and inner hub 33. Tightening bolts 41 moves retaining cylinder 37 downward against the resilient tube 35. This deforms tube 35 between the walls of the outer pipe 21 and inner hub 33, locking them together.

The bearing means includes upper and lower bearing pad assemblies 43, 45 attached to the outer wall 33*b* of the inner hub 33. Each lower bearing pad assembly 45 is secured to the inner hub 33 by two annular brackets 47, 49 spaced vertically apart. The upper bracket 47 has a lesser outer diameter than the lower bracket 49. The lower bracket 49 is located at the bottom of the inner hub 33. The different diameters of the annular brackets 47, 49, position the bearing pad assemblies to that they face generally upward and outward. A line drawn tangent to the face of one of the bearing pad assemblies 45 and intersecting the drill string axis would intersect at an angle of about 35°.

The upper bearing pad assemblies are secured to the inner hub 33 above the lower bearing pad assemblies by bolts 51 and an annular bracket 53. Bracket 53 has a horizontal annular portion 53*a* and a vertical cylindrical portion 53*b*. Cylindrical portion 53*b* slides closely over the hub outer wall 33*b* and is keyed to wall 33*b* with two vertical keys (not shown). Horizontal portion 53*a* extends over the top of cap 33*c* and is bolted into the outer wall 33*b*. The upper and lower ends of the upper bearing pad assemblies 43 are secured to the horizontal and cylindrical portions 53*a* and 53*b* so as to orient the bearing pad assemblies generally outward and downward. A line drawn tangent to the face of one of the upper bearing pad assemblies 43 and intersecting the drill pipe axis would intersect at about 35°. Shims 55 can be placed beneath the horizontal portion 53*a* of the mounting bracket to vary the distance between the upper and lower bearing pad assemblies 43, 45.

Figure 4:
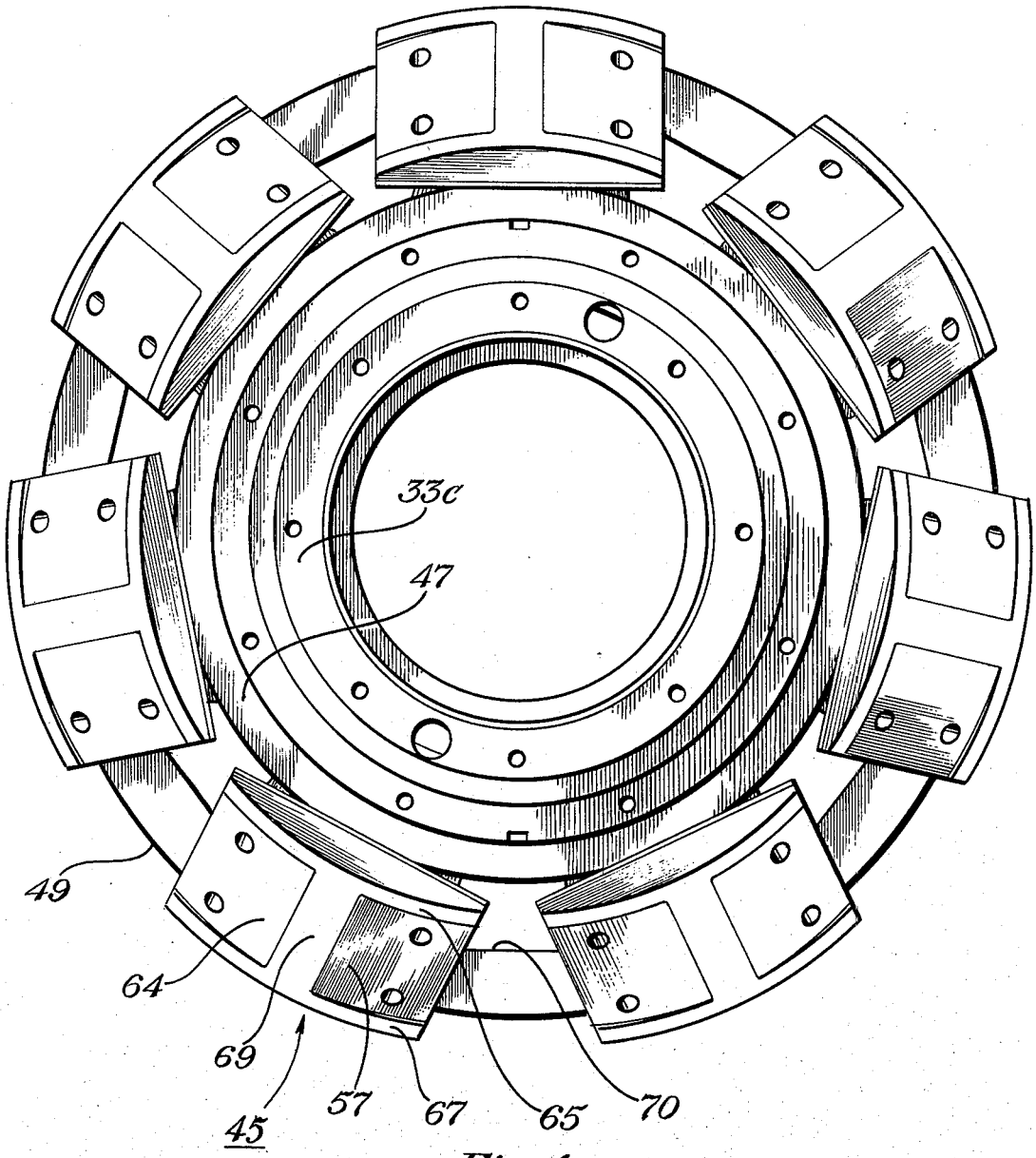
FIG. 4 is a top view of the inner of the stabilizer of FIG. 1 with lower bearing pads attached.

The bearing pad assemblies 43, 45 in the preferred embodiment comprise seven individual pieces spaced in a circular array, with spaces between them. FIG. 4 shows the lower bearing pad assemblies 45, the upper pad assemblies being the same in configuration and spacing. Each bearing pad assembly 43, 45 comprises a resilient pad or layer 57 of rubber or the like bonded to a metal base 59, shown in FIG. 2. Metal base 59 is in turn secured to a rectangular metal plate 61 by bolt 63. Rectangular apertures 70 (FIG. 4) are formed through plate 49 to provide access to the bolts. For the lower bearing pad assemblies 45, the rectangular plates 61 are welded to brackets 47, 49. For the upper bearing pad assemblies 43, the rectangular plates 61 are welded to the horizontal and vertical portions 53*a*, 53*b* of the mounting bracket.

Referring again to FIG. 4, each resilient pad 57 has tapered recessed areas 64 for trapping fluid for lubrication. The pads 57 are generally rectangular and convex, with upper and lower ribs 65, 67 on the upper and lower edges. Ribs 65, 67 are approximately ½ inch wide and are connected together in the center of the pad by a central vertical strip 69. Strip 69 is about 4 inches wide, the total width of pad 57 being about 14 inches and its height about 12 inches. The recessed areas 64 are rectangular areas bounded by the upper and lower ribs 65, 67. Strip 69 is located between each recessed area 64 on each pad 57. Each recessed area 64 commences at strip 69 and gradually deepens toward the leading and trailing edges. At the leading and trailing edges, the depth of the recessed areas 64 is about 3/16 inch. At the commencement with the center strip 69, the ribs 65, 67, recessed areas 64 and center strip 69 are flush with each other.

Referring again to FIG. 2, an outer hub 71 encircles inner hub 33. Outer hub 71 is a cylindrical wall, and has a pair of frusto-conical drums or rings 73, 75 mounted to its inner side. The rings 73, 75 are metal with chrome plated inner surfaces mating with the upper and lower bearing pad assemblies 43, 45. The rings 73, 75 are mounted concentric to the drill string axis. An annular mounting block 77 is welded to the inside of outer hub 71 in its vertical center. The rings 73, 75 are bolted between the mounting block 77 and outer hub 71, so that they form an even sliding contact with the resilient layers 57. Lower ring 75 will face generally downward and inward. The upper ring 73 will face generally upward and inward. The inner edges of the rings are adjacent to each other. The seven bearing pad assemblies cover approximately 75% of the area of the rings.

Figure 3:
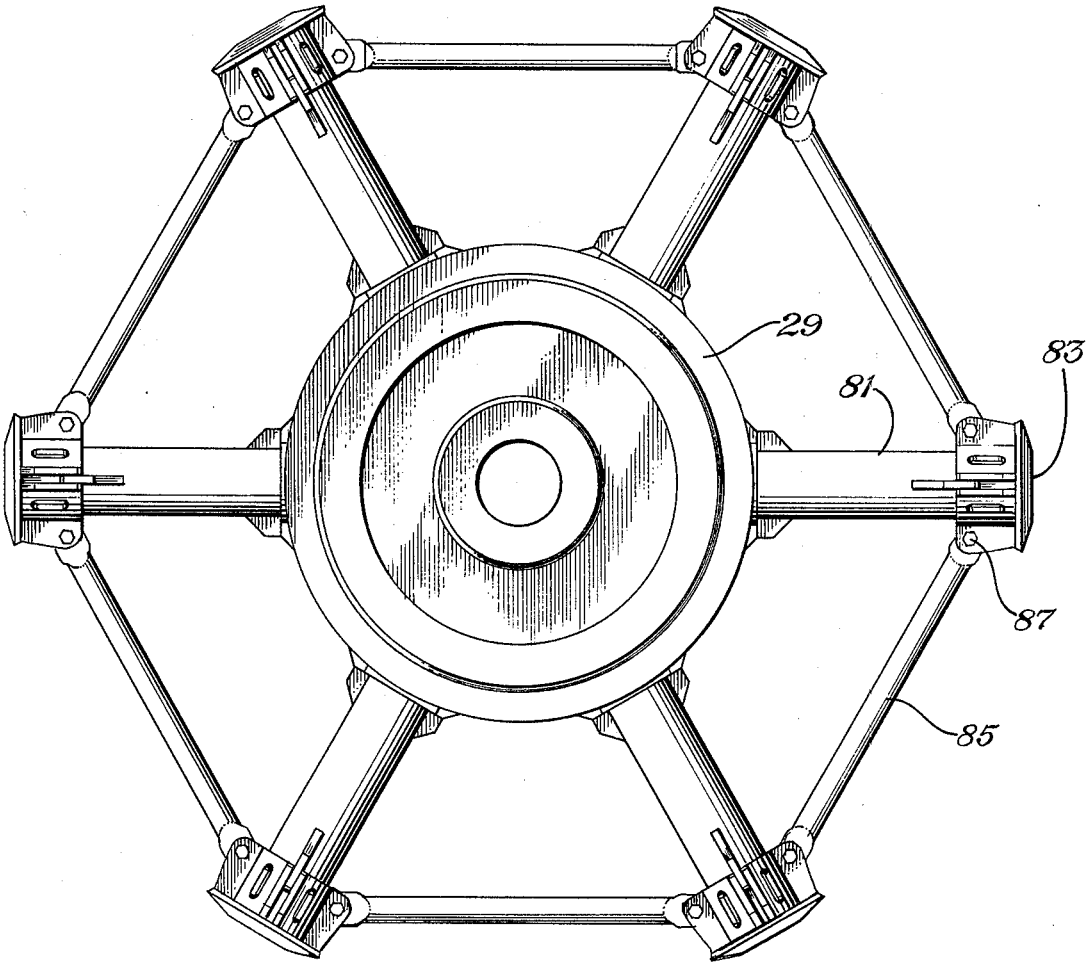
FIG. 3 is a top view of the stabilizer of FIG. 1.

The centralizing means for centering the drill string includes six cylindrical housings or receptacles 79 uniformly spaced around outer hub 71. Each receptacle 79 is adapted to slidingly or telescopingly receive a cylindrical arm 81. The arms 81 extend radially outward, perpendicular to the drill string axis, with the spaces between them serving as passage means for fluid in the shaft. A metal plate or shoe 83 is mounted to the outer end of each arm for contacting the wall of the shaft 13. As shown in FIG. 3, six tie bars 85 connect the ends of the arms 81 together. Each tie bar 85 is fastened between two shoes 83 by pins 87. The length of arms 81 is selected so that the width across the stabilizer will be substantially equal to the diameter of the shaft 13. It is preferred to have a slightly lesser width, providing approximately one inch radial clearance. The receptacles 79, arms 81, shoes 83, and tie bars 85 define a centralizing means or lateral member for preventing the drill string from moving substantially from the center of the shaft.

In operation, the stabilizer 27 can be assembled by first placing the lower adapter plate 31 on a weight 25. Then the inner hub 33 is placed on the adapter plate 31, with the lower bearing pad assemblies 45 secured to it. Resilient tube 35 is inserted between outer pipe 21 and inner hub 33. The metal retaining cylinder 37 is placed on the resilient tube, and retaining ring 39 is tightened until the inner hub is tightly secured to the drill string.

The outer hub 79 is inserted over the inner hub 33, causing lower ring 75 to rest on the rubber layer 57 of the lower bearing pad assemblies 45. A selected number of shims 55 are placed on top of the inner hub 33. The upper bearing pad assemblies 43 along with their mounting bracket 53 are lowered over the inner hub 33, placing the upper bearing pad assemblies 43 in contact with the upper conical plate 73. Bolts 51 are tightened to lock the upper bearing pads in contact with the upper plate. The upper adapter plate 29 is placed on top of retaining ring 39, and additional weights 25 are placed above. (The weights 25 are supported by the inner hub, thus their weight will not affect the bearing pads and rings.)

The arms 81 are inserted in receptacles 79. If the opening in the rig floor is smaller than the bit diameter, then the arms should be inserted only when the stabilizer is below the rig floor. Tie bars 85 are fastened to the shoes 83 and the stabilizer is ready for use.

In operation, inner hub 33 and bearing pad assemblies 43, 45 will rotate with the drill string since they are locked by the resilient tube 35. When the shoes 83 are in contact with the shaft wall, they will restrain the arms from rotation and cause the conical rings 73, 75 to slide on the bearing pad assemblies 43, 45. Since the stabilizer is slightly less in diameter than the shaft, the arms will rotate a short distance from time to time. However, the uneven texture of the shaft wall and slight misalignment will prevent substantial rotation of the arms. Also, there is some resistance to rotation created by the fluid in the shaft.

The stabilizer must be immersed in shaft fluid so that the fluid can pass between the individual bearing pad assemblies and immerse the conical rings 73, 75. The recessed areas 64 in the resilient layers 57 will trap fluid and lubricate the bearing surfaces. Forces exerted on the shoes 83 will be transmitted through these bearings. The inclination of the bearing surfaces allows them to transmit upward and downward forces, as well as inward forces.

It should be apparent that an invention having significant advantages has been provided. The stabilizer arms do not rotate with the bit, reducing wear on the part of the stabilizer in contact with the shaft wall. The arms are quickly detachable. This allows them to be removed below the rig floor so that the stabilizer hub can be pulled through the rig floor openings to gain access to the bit. The bearing is lubricated by drilling fluid, avoiding the need for sealing a separate lubricant reservoir. The resilient pads and metal conical rings are resistant to the abrasive effect of the particles in the shaft fluid.

While the invention has been shown in only one of its forms, it should be apparent to those skilled in the art that it is not so limited but is susceptible to various changes and modifications without departing from the spirit thereof. For example the rubber pad assemblies could be mounted to the outer hub and the metal conical plates mounted to the inner hub.

We claim:

1. An apparatus for maintaining a drill string in the center of a shaft while drilling, comprising:

a hub carried by the drill string for rotation therewith;

centralizing means extended laterally outward of the hub and having a width substantially the diameter of the shaft for preventing the drill string from moving substantially from the center of the shaft;

the centralizing means having passage means for allowing fluid in the shaft to flow past the centralizing means; and bearing means mounted between the hub and the centralizing means for allowing the drill pipe and hub to rotate with respect to the centralizing means;

the bearing means including a metal bearing surface and a plurality of individual resilient pads spaced apart from each other and in sliding contact with the bearing surface, the pads and bearing surface being exposed to the fluid in the shaft.

2. An apparatus for maintaining a drill string in the center of a shaft while drilling, comprising:

an inner hub secured to the drill string for rotation therewith;

an outer hub encircling the inner hub;

a metal frusto-conical ring secured to one of the hubs;

a resilient bearing pad secured to the other hub in sliding contact with the ring, the ring and pad being exposed to fluid in the shaft; and centralizing means extending laterally outward from the outer hub for preventing the drill string from moving substantially from the center of the shaft;

the centralizing means having passage means for allowing fluid in the shaft to flow past the centralizing means.

3. An apparatus for maintaining a drill string in the center of a shaft while drilling, comprising:

an inner hub secured to the drill string for for rotation therewith;

an outer hub encircling the inner hub;

upper and lower resilient bearing pads secured to one of the hubs;

upper and lower metal rings secured to the other hub and encircling the drill string;

the upper and lower rings slidingly mating with the upper and lower bearing pads respectively;

the rings and bearing pads being exposed to drilling fluid;

centralizing means extending laterally outward from the outer hub for preventing the drill string from moving substantially from the center of the shaft; and passage means in the centralizing means for allowing drilling fluid to flow past the centralizing means.

4. An apparatus for centering a drill string in a shaft comprising:

an inner hub secured to the drill string for rotation therewith;

an outer hub encircling the inner hub;

a plurality of upper and lower bearing pads of resilient material secured to the inner hub and spaced in a circular array with spaces between each bearing pad to allow drilling fluid in the shaft to enter;

the upper bearing pads facing generally downwardly and outwardly;

the lower bearing pads being mounted below the upper bearing pads and facing generally upwardly and outwardly;

upper and lower metal frusto-conical rings mounted to the outer hub, one above the other;

the upper ring slidingly mating with the upper bearing pads and the lower ring slidingly mating with the lower bearing pads, so as to allow the inner hub to rotate with respect to the outer hub; and a lateral member rigidly mounted to the outer hub perpendicular to the axis of the drill string and extending laterally outward from the outer hub;

the lateral member being in substantial contact with the shaft wall to prevent the drill string from moving substantially from the center of the shaft;

the lateral member having passage means for allowing drilling fluid to flow past the lateral member.